US006342015B1

(12) United States Patent
Robertson et al.

(10) Patent No.: US 6,342,015 B1
(45) Date of Patent: Jan. 29, 2002

(54) DOUBLE WALL SLIDE WITH VARYING SLOPED SLIDE BED PLAYGROUND SLIDE

(75) Inventors: Jeffrey S. Robertson, Canton, GA (US); Graham C. Lobban, Waterloo (CA)

(73) Assignee: Playnation Play Systems, Inc., Marietta, GA (US)

( * ) Notice: Subject to any disclaimer, the term of this patent is extended or adjusted under 35 U.S.C. 154(b) by 0 days.

(21) Appl. No.: 09/524,207

(22) Filed: Mar. 10, 2000

(51) Int. Cl.[7] ..... A63G 21/02
(52) U.S. Cl. ..... 472/116; 472/88
(58) Field of Search ..... 472/88, 89, 90, 472/116, 117, 136; 104/69, 70

(56) References Cited

U.S. PATENT DOCUMENTS

| | | | | |
|---|---|---|---|---|
| 4,299,171 A | * | 11/1981 | Larson | 104/70 |
| 4,966,309 A | | 10/1990 | Baer | |
| D336,674 S | | 6/1993 | Baer | |
| 5,427,574 A | * | 6/1995 | Donnelly-Weide | 472/116 |
| D384,722 S | | 10/1997 | Siragusa, Jr. et al. | |
| 5,688,180 A | | 11/1997 | Siragusa et al. | |
| D388,148 S | | 12/1997 | Sutton et al. | |
| D392,363 S | | 3/1998 | Jonas | |
| 5,816,980 A | * | 10/1998 | Myszka et al. | 482/35 |
| 5,931,100 A | | 8/1999 | Sutton et al. | |

OTHER PUBLICATIONS

PlayNation Play Systems, Inc. brochure entitled "Explore the World of Playnation," pp. 1–27 (undated).
Miracle Recreation Equipment Company (a Division of Playpower, Inc.) brochure, pp. 1–2 (undated).
NewCo Product, Inc. "Assembly Instructions," pp. 3–4 (publication date unknown—admitted to have been published prior to filing date).

* cited by examiner

*Primary Examiner*—Kien T. Nguyen
(74) *Attorney, Agent, or Firm*—Kilpatrick Stockton LLP

(57) ABSTRACT

A double wall scoop shaped residential slide with an integrally formed footing attached to the underside of the slide bed and varying slope slide bed. The slide is formed from a one piece rotational molded process. The slide surface and walls form a U-shaped scoop defining a semi-circular slide bed, allowing for increased safety and structural support. The scooped shape provides integrally formed side walls which prevent the user from falling off the slide during use. The built-in footing is advantageous because it lowers manufacturing costs while increases stability and safety of the slide.

10 Claims, 2 Drawing Sheets

DOUBLE WALL SLIDE WITH VARYING SLOPED SLIDE BED PLAYGROUND SLIDE

FIELD OF THE INVENTION

This invention relates to slides and, more specifically, to molded playground slides for residential use.

BACKGROUND OF THE INVENTION

Playgrounds can be found in every city. Although the equipment varies considerably among playgrounds, a common objective of all playground equipment is to provide a safe and entertaining atmosphere for children of all ages.

One piece of equipment found in most residential playgrounds is the slide. Typically, residential playground slides include a slide bed with a supported top surface and a bottom surface that rests on a separate footing, connected to the underside of the slide bed. When a typical slide bed is installed, the slope of the slide bed is somewhere between 30° and 60°. Slide beds are generally made from wood, metal, plastic or any other materials with a low friction coefficient, or materials that can be treated to reduce the friction coefficient. For safety reasons, slide beds are bounded by attached side walls to keep the user from falling off the slide. Most slide bed walls are a few inches in height.

Typical residential playground slides have many disadvantages. First, most residential slides are molded with a single wall design. This is inferior because a single wall provides less stability from flexing and requires that the slide walls be thick enough to provide the necessary stability of a safe slide. Additionally, the added thickness results in increased weight and costs associated with manufacturing. Second, most residential slides contain constant sloped slide beds reducing the slide speed. In addition, residential slides contain separate footings. These footings can separate from the underside of the slide bed overturning, creating a potentially dangerous condition. Finally, typical residential slides have very low side walls for stopping the user from falling of the slide bed.

Most residential playground slides are molded from plastic material, such as polyethylene or similar material. Plastic molded residential slides generally contain a single wall design. Single wall slides are disadvantageous in that they flex when weight is applied to the slide bed. The flexing of the slide bed destabilizes the overall slide. Such instability can result in serious injuries. To counteract the instability, manufacturers of single wall slides may add additional supports to the slide; for example, a strut may be placed under a portion of the slide bed. However, this solution adds expense and assembly complexity to the slide.

Another disadvantage of residential slide beds is that their slide beds have a constant slope design with transitions at the entrance and exit areas. The transition areas are generally of a reduced slope allowing for easy ingress on and egress off the slide. The constant slope provides a slow and uneventful ride down the slide. Thus, children become bored and find other methods of traversing the slide, such as sliding down while standing up, which can cause severe injuries.

Stable slide beds are imperative for providing safe playground equipment in the residential market. Current residential slide beds contain separate footings for resting on the ground. Generally, the footing is connected, during installation, to the underside of the slide. Unfortunately, a separate footing weakens the overall stability of the slide, especially under heavy use conditions.

Lastly, the most important function of residential playground slides is to provide a piece of equipment that keeps the user from falling off and injuring themselves. But common residential slides contain flat slide beds with low side walls. The side walls function to keep the user on the slide bed and from injuring themselves.

The above mentioned disadvantages are overcome by the slide of the present invention as described below in the summary of the invention.

SUMMARY OF THE INVENTION

This invention is a double wall, scooped slide with a variable slope bed and integrally formed footing for use in residential playground setups. A rotational molded process forms the slide as a single piece. The slide includes a foot for raising the bottom end of the slide bed off the ground. The slide bed's surface and walls are formed as a generally U-shaped, semi-circular slide bed, allowing for increased safety and structural support. The scooped shape provides a geometric contour and higher side walls that collectively help prevent the user from falling off the slide. The built-in footing lowers manufacturing costs. In addition, the unitary, single piece slide bed and footing increases stability and safety of the slide. The increased safety and stability result because the footing will not separate from the slide bed during operation of the slide.

The slide is rotationally molded from plastic, for example, polyethylene. The mold forms a double wall design increasing structural stability and eliminating the need for attached support structures. In addition, the present invention contains a variable sloped slide bed. The variable slope design allows the user to accelerate while traversing the slide. The acceleration is accomplished without increasing the height of the slide or jeopardizing the safety of the user.

The present invention seeks to accomplish the following objectives:

- to provide a slide with a double walled design increasing strength and stability;
- to cost effectively provide a double walled slide;
- to provide a slide with an integrated molded foot, thereby further decreasing manufacturing costs and increasing overall slide stability;
- to provide a slide with a variable slope slide bed surface for increasing acceleration of the user; and
- to provide a safe slide producing increased speeds.

Further objects and advantages will become apparent from the following description, the accompanying drawings and the claims.

DETAILED DESCRIPTION OF THE DRAWINGS

Figure 1:
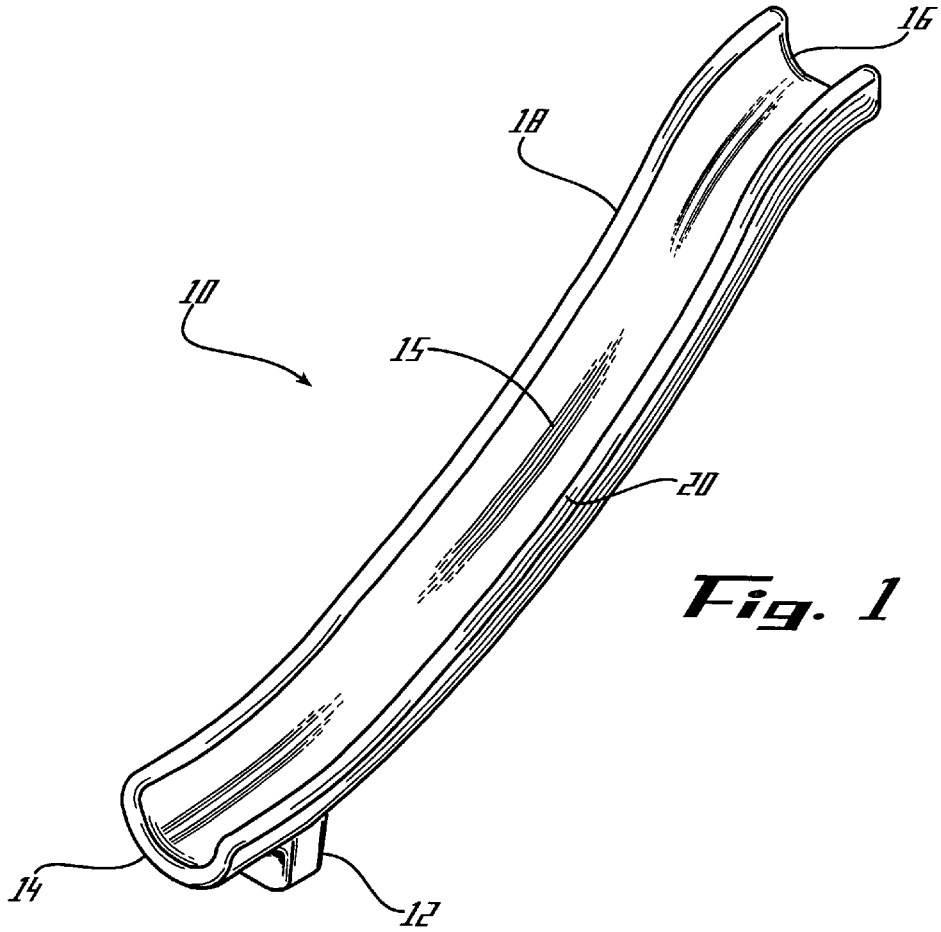
FIG. 1 is a perspective view of an exemplary slide of this invention.

FIG. 1 shows a double wall scooped slide ("slide") 10. Slide 10 may be formed from plastic, such as, polyethylene or some similar material using a rotational molding process, or other suitable process for molding plastic. Slide 10 has a first end 16 and second end 14 between which ends 14,16 is a slide bed 15. The first end 16 is the entrance area and the second end 14 is the exit area. The first end 16 attaches to a platform. An integrated molded foot 12 raises second end 14 approximately 7 inches off the ground. Foot 12 is manufactured as part of the underside of slide bed 15 during the rotational molding process.

Figure 3:
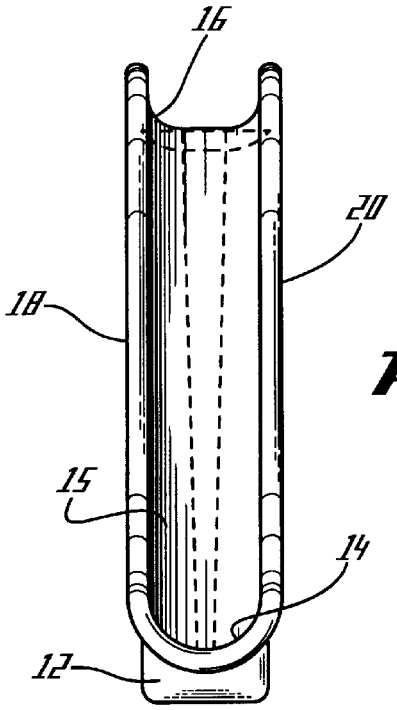
FIG. 3 is a front view of the slide of FIG. 1.
Figure 4:
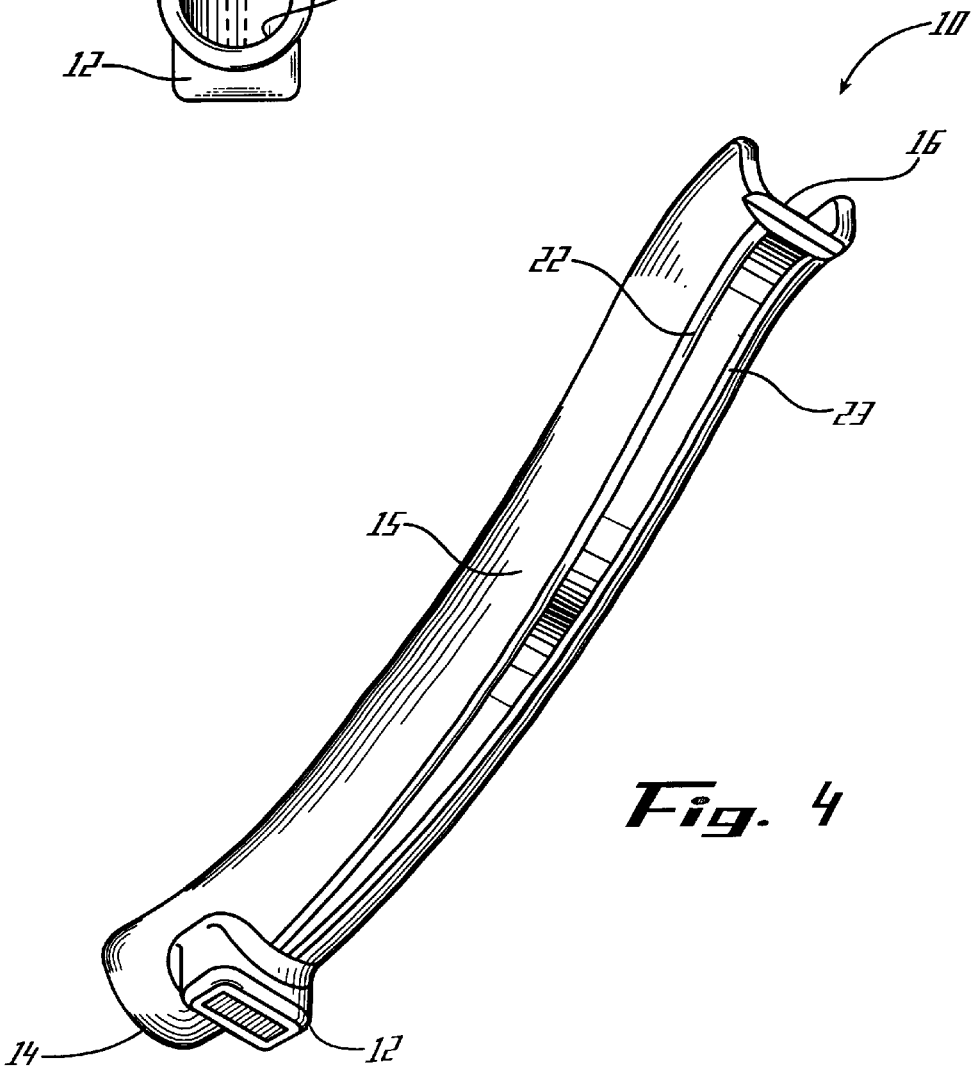
FIG. 4 is a perspective view, from the bottom, of the slide of FIG. 1.

Slide bed 15 is shaped as a U-shaped scoop with integrally coupled side walls 18 and 20. The scooped U-shaped form creates a generally semi-circular slide bed 15. Slide bed 15, integrated side walls 18 and 20, and integrated molded foot 12 are formed from a one piece double walled design (see FIGS. 3–4). Slide 10 also includes preformed, integrated, molded ribs 22 and 23 that run along the longitudinal axis of the semi-circular slide bed 15. Ribs 22 and 23 provide added stability and structural strength to slide bed 15.

Figure 2:
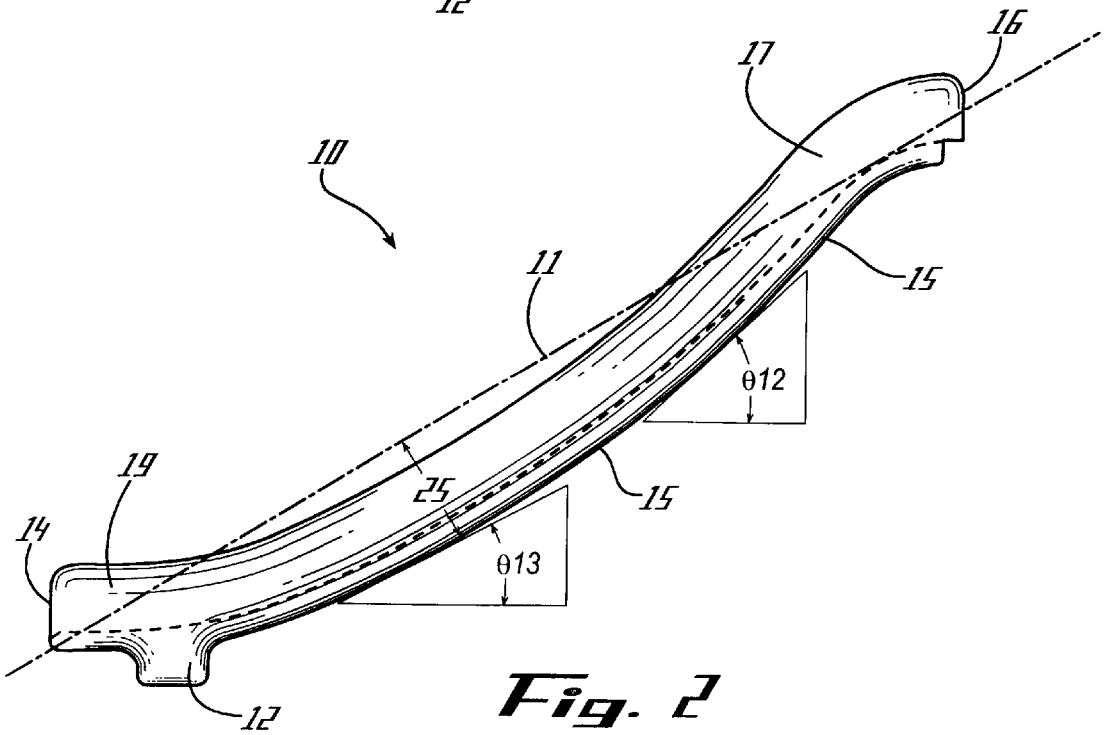
FIG. 2 is a side view of the slide of FIG. 1.

Referring to FIG. 2, slide 10 omits the ordinary constant sloped design of common residential slides. Instead, slide 10 contains a shallow slope at the first end 16, with a varying slope between points 17 and 19, at which point the slope begins to shallow out again at end 14. The transition from a shallow to increased and back to a shallow slope creates a dip 25, that deviates from a constant slope line 11, running from first end 16 to the second end 14, as best seen in FIG. 2. Dip 25 forms an area of the slide bed 15 that accelerates a user in speed while she traverses the length of slide bed 15. The acceleration down the slide is due to the force of gravity exerted on the user and an angle theta (θ) between a line parallel to the ground and a line tangent to the slope of the slide bed 15, along any given point on slide bed 15. Therefore, as the angle theta (θ) 12 increases due to an increasing slope the acceleration of the moving body along this portion of slide 15 increases, and as the angle theta (θ) 13 decreases along this portion of slide 15, deceleration of the moving body occurs.

As best illustrated in FIG. 2, a slide bed with a constant slope is represented by the dashed line 11. The varying slope design is clearly seen by comparing slide bed 15 of the present invention with line 11 representing the constant sloped slide bed. Slide bed 15 dramatically dips below line 11 because of the varying slope. Although the slope of slide bed 15 produces accelerated speeds, safety is never compromised because of the scooped wall design resulting in high sturdy walls 18 and 20.

The forgoing is provided for purposes of illustrating, explaining, and describing embodiments of the present invention, a U-shaped, double wall, varying sloped residential slide with integrated footing. Modifications and adaptations to these embodiments will be apparent to those skilled in the art and may be made without departing from the spirit of the invention or the scope of the following claims.

What is claimed is:

1. A residential playground slide for mounting to an above-ground platform, comprising:

a. a double wall slide bed surface formed in a U-shaped scoop defining a flat bottom U-shape at a first end and a semi-circular U-shape at a second end, wherein the surface of the scoop becomes generally progressively curved from the first end towards the second end, and with a first and a second side wall formed integrally with the slide bed, wherein the first and second side walls assist in preventing a user from falling off to a side of the slide bed;

b. the first end attaching to a platform and the second end proximate with the ground;

c. a footing integrally formed with the second end for holding the second end off the ground;

d. the slide bed having a varying slope from the first end to the second end for causing the user to experience a variable acceleration rate while traversing the slide; and e. a strut integrally formed with the underside of the slide bed and parallel to the longitudinal axis of the slide bed.

2. The slide of claim 1, further comprising a plurality of integrally attached struts coupled to the underside of the slide bed, each of which struts extend parallel to the longitudinal axis of the slide bed, and correspond with the progressive curvature of the scoop such that the struts approach a common point near the second end of the scoop.

3. The slide of claim 2, wherein the slide bed, footing, and struts comprise a single piece manufactured via a rotational molding process.

4. The slide of claim 3, wherein the slope of the slide bed varying between the first and second end is initially a shallow slope at the first end, with an increased slope between the first and second ends, and a transition to a shallow slope at the second end.

5. A residential playground slide manufactured into a single integral piece by a rotational molding process, comprising:

a slide bed with a variably sloped portion beginning at one end of the slide bed and relative to a longitudinal axis of the slide bed, and a scooped portion with respect to an opposing end of the slide bed;

a double wall along at least two longitudinal sides of the slide bed thus forming a generally U-shaped semi-circular cross-section along the longitudinal axis of the slide bed, wherein the variably sloped portion of the slide bed creates an angle theta (Θ) with respect to a line parallel to the ground and a line tangent to the slope of the slide bed along any given point on the slide bed, the angle theta (Θ) becoming generally progressively larger from one end of the slide bed towards the scooped portion of the slide bed, and then the angle theta (Θ) becoming decreasing smaller near the scooped portion of the slide bed; and a strut integrally formed with the underside of the slide bed and parallel to the longitudinal axis of the slide bed.

6. The slide of claim 5, further comprising:

a footing that is integrally formed with the slide bed, double wall, and strut in the rotational molding process.

7. The slide of claim 6, wherein the footing mounts to the underside of the slide bed.

8. The slide of claim 5, further comprising a plurality of integrally attached struts coupled to the underside of the slide bed, each of which struts extend parallel to the longitudinal axis of the slide bed, and correspond with the slope of the variably sloped portion of the slide bed such that the struts approach a common point near the scooped portion of the slide bed.

9. The slide of claim 5, wherein the slide is manufactured in the rotational molding process from a plastic material.

10.The slide of claim 9, wherein the plastic material is polyethylene.

* * * * *